US008189024B2

(12) United States Patent
Nishimura et al.

(10) Patent No.: US 8,189,024 B2
(45) Date of Patent: May 29, 2012

(54) NEUTRALIZATION APPARATUS AND PRINTER HAVING NEUTRALIZATION APPARATUS

(75) Inventors: Takanobu Nishimura, Kanagawa (JP); Yukio Asari, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 260 days.

(21) Appl. No.: 12/713,964

(22) Filed: Feb. 26, 2010

(65) Prior Publication Data

US 2010/0289863 A1 Nov. 18, 2010

(30) Foreign Application Priority Data

May 12, 2009 (JP) ..... 2009-115748

(51) Int. Cl.

| | |
|---|---|
| ***B41J 35/00*** | (2006.01) |
| ***H05F 3/06*** | (2006.01) |
| ***H05F 3/02*** | (2006.01) |
| ***H05F 3/04*** | (2006.01) |

(52) U.S. Cl. ..... 347/217; 361/220; 361/221

(58) Field of Classification Search ..... 347/217; 361/212, 220, 221

See application file for complete search history.

(56) References Cited

U.S. PATENT DOCUMENTS

| | | | | |
|---|---|---|---|---|
| 3,670,203 | A * | 6/1972 | Whitmore | 361/225 |
| 3,671,806 | A * | 6/1972 | Whitmore et al. | 361/212 |
| 4,363,070 | A * | 12/1982 | Kisler | 361/212 |
| 4,402,035 | A * | 8/1983 | Kisler | 361/213 |
| 4,517,143 | A * | 5/1985 | Kisler | 264/484 |
| 4,825,334 | A * | 4/1989 | Kisler | 361/212 |
| 5,895,632 | A * | 4/1999 | Nomura et al. | 422/186.04 |
| 7,846,279 | B2 * | 12/2010 | Oh et al. | 156/72 |

FOREIGN PATENT DOCUMENTS

| | | |
|---|---|---|
| EP | 1 055 522 A1 | 11/2000 |
| EP | 1 095 783 A2 | 5/2001 |
| GB | 2 151 556 | 7/1985 |
| JP | 05-045971 | 2/1993 |
| JP | 07-142187 | 6/1995 |
| JP | 11-286128 | 10/1999 |
| JP | 2002-236331 | 8/2002 |
| JP | 2006-216453 | 8/2006 |
| KR | 10-0370214 | 1/2003 |

OTHER PUBLICATIONS

European Search Report dated Jul. 29, 2011.
Korean Office Action dated Dec. 28, 2012.

* cited by examiner

*Primary Examiner* — Huan Tran
(74) *Attorney, Agent, or Firm* — Pillsbury Winthrop Shaw Pittman, LLP

(57) ABSTRACT

The invention provides a neutralization apparatus which simplifies an apparatus composition, lowers an apparatus cost and removes electrical charge effectively from a ribbon-like substance which is charged by stripping, and provides a printer having the neutralization apparatus. The neutralization apparatus neutralizes an ink ribbon. The neutralization apparatus has a conductive roller which is arranged so as to contact the surface of the ink ribbon and a neutralization brush which counters the back of the ink ribbon. A balance of the electrical charge of the surface and the electrical charge of the back of the ink ribbon is broken by electrical discharge caused by the conductive roller. And thereby, the charged voltage of the electrical charge of the back of the ink ribbon becomes large and the neutralization brush remove the electrical charge charged to the back of the ink ribbon effectively.

20 Claims, 10 Drawing Sheets

NEUTRALIZATION APPARATUS AND PRINTER HAVING NEUTRALIZATION APPARATUS

CROSS REFERENCE TO RELATED APPLICATION

This application is based upon and claims the benefit of priority from Japanese Patent Application No. 2009-115748, filed on May 12, 2009, the entire contents of which are incorporated herein by reference.

FIELD OF THE INVENTION

The invention relates to a neutralization apparatus to remove or eliminate electrical charge charged to a ribbon-like substance, and relates to a printer having the neutralization apparatus. In particular, the invention relates to the printer which runs an ink ribbon along with a print medium and carries out heat transfer of ink to the print medium by a thermal head, and relates to the neutralization apparatus which moves or eliminates the electrical charge charged to the ink ribbon of the printer.

DESCRIPTION OF THE BACKGROUND

In recent years, a printer which prints high definition images, such as a photograph of man's face, to a comparatively small print medium, such as an ID card and a bank passbook, is known. This printer uses the ink ribbon. The ink ribbon has color ink which is fused by heating and is applied to a ribbon-like resin film. In this kind of printer, an intermediate transfer film and the ink ribbon are overlapped and conveyed, for example, the color ink of the ink ribbon is fused by a thermal head, and the ink of each color is transferred on the intermediate transfer film. And then, the printer prints a color image on the print medium by transferring the ink transferred on the intermediate transfer film to the print medium.

One end of the ink ribbon is wound around a supply axis, and the other end of the ink ribbon is wound around a rolling up axis. The ink ribbon supplied from the supply axis passes the thermal head and is wound around the rolling up axis. When the ink ribbon is sent out from the supply axis side, the ink ribbon sent out exfoliates from the ink ribbon of rolled form wound around the supply axis. At this time, static electrical charge by stripping is produced in both the ink ribbon of rolled form wound around the supply axis and the ink ribbon sent out.

Such electrification of the ink ribbon tends to differ in polarity with the surface and the back of the ink ribbon. And a quantity of the electrification which is generated when the ink ribbon is exfoliated differs depending upon combination of the overlapping ink colors when the ink ribbon was wound around the supply axis. A diameter of a roll of the ink ribbon wound around the supply axis becomes small gradually as the ink ribbon is sent out. Thus, although a color pattern of a longitudinal direction of the ink ribbon has regularity, the overlap condition of the colors of the ink ribbon wound is irregular. Accordingly, the electrification characteristic of the ink ribbon sent out from the supply axis also becomes irregular.

On the other hand, the thermal head carries out printing by the peeling-off during hot state which exfoliates the ink from the resin film before the temperature of the ink falls. Generally as the thermal head, a near edge type thermal head or a corner edge type thermal head is used. It is known that electrical discharges based on Paschen's law will often arise between the ink ribbon and the thermal head when the electrically charged ink ribbon passes the thermal head. The electrical discharges often arise a problem of destroying the thermal head. For this reason, in prior to a stage where the ink ribbon passes the thermal head, it is necessary to remove the electrical charge charged to the ink ribbon to such an extent that the ink ribbon does not produce the electrical discharge between the ink ribbon and the thermal head.

Following methods are known as a neutralization method for removing the electrical charge charged to the resin film. 1) A method for spraying ionized air on a film in a high voltage alternative ionization chamber is disclosed in JP, P2006-216453A, and JP, P2002-236331A, for example. 2) A method for generating ion by contacting a conductive roller connected to a high voltage alternative power supply to both surfaces of a film and producing electrical discharge is disclosed in JP, PH07-142187A, for example.

However, a neutralization apparatus using a high voltage power supply needs a control system, an electrode, a blower, etc., and needs a comparatively large installing space. This kind of neutralization apparatus needs an initial facility cost and a high running cost. For this reason, it is difficult to use such a large-scale neutralization apparatus for a comparatively small table type printer using the ink ribbon mentioned above.

SUMMARY OF THE INVENTION

A purpose of the invention is to provide a neutralization apparatus which simplifies an apparatus composition, makes apparatus cost low and removes effectively an electrical charge charged to a ribbon-like substance, and to provide a printer having the neutralization apparatus.

According to an embodiment of the invention, a neutralization apparatus includes a neutralization unit grounded and a self-discharge type neutralization grounded. The neutralization unit is in contact with one surface of a ribbon-like substance sent out from the ribbon-like substance wound around rolled form to generate static electrical charge by stripping. The neutralization unit removes the static electrical charge charged to one surface of the ribbon-like substance by producing electrical discharge between the neutralization unit and the one surface of the ribbon-like substance. The self-discharge type neutralization brush counters another surface of the ribbon-like substance and is separated from the ribbon-like substance in a lower stream side than the neutralization unit along a direction where the ribbon-like substance is sent out. The self-discharge type neutralization brush removes the static electrical charge charged to another surface of the ribbon-like substance.

According to an embodiment of the invention, a printer includes a supply axis, a rolling up axis, a thermal head, an neutralization unit grounded, an neutralization unit grounded. The supply axis is wound with an ink ribbon which has a ribbon-like resin film and an ink layer held on the ribbon-like resin film. The rolling up axis is configured to roll up the ink ribbon sent out from the supply axis. The thermal head is arranged in the resin film side of the ink ribbon which runs between the supply axis and the rolling up axis. The neutralization unit is arranged so as to contact the resin film of the ink ribbon in an upper stream side than the thermal head along a direction where the ink ribbon is sent out from the supply axis. The neutralization unit is configured to remove electrical charge charged to the resin film by producing electrical discharge between the neutralization unit and the resin film. The neutralization unit is arranged at a position in a lower stream side than the neutralization unit and in an upper stream side than the thermal head along a direction where the ink ribbon is sent out, and counters the ink layer of the ink ribbon.

DETAILED DESCRIPTION OF THE INVENTION

Figure 1:
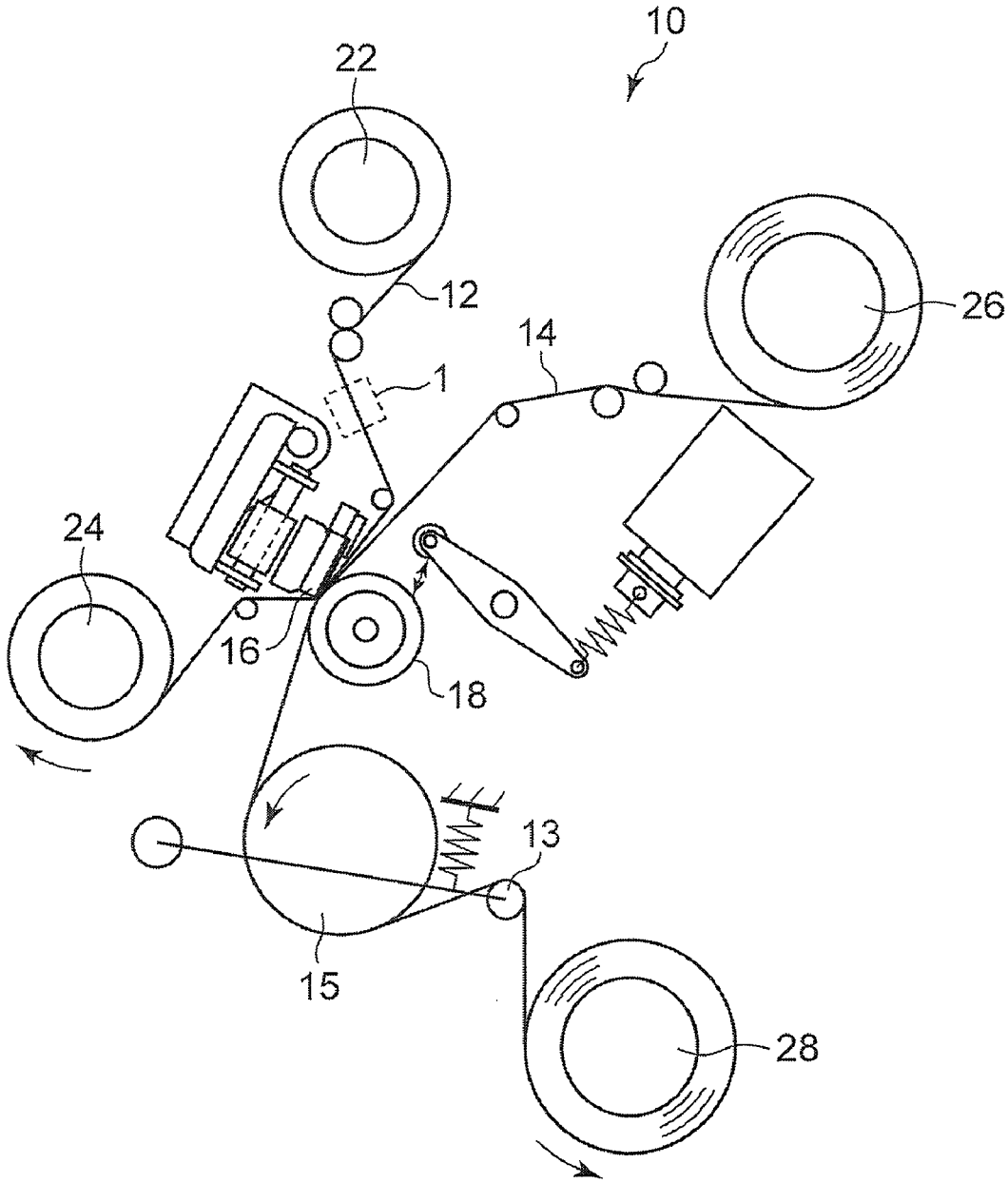
FIG. 1 is a schematic diagram of a printer according to an embodiment of this invention.
Figure 2:
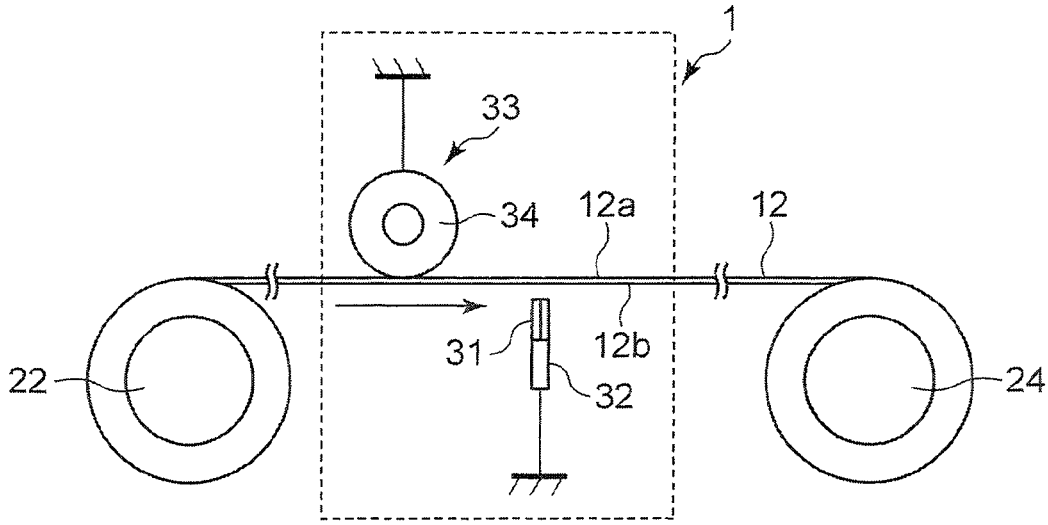
FIG. 2 is a schematic diagram explaining a neutralization apparatus of the embodiment.

Hereinafter, an embodiment of the invention will be explained in detail with reference to the drawings. FIG. 1 is a schematic diagram of a printer 10 incorporating a neutralization apparatus 1 concerning one embodiment of the invention. FIG. 2 is a schematic diagram of the neutralization apparatus 1.

In FIG. 1, the printer 10 includes ink ribbon 12, an intermediate transfer film 14, a thermal head 16, a supply axis 22 for the ink ribbon 12, a rolling up axis 24 for the ink ribbon, a supply axis 26 for the intermediate transfer film 14, a rolling up axis 28 for the intermediate transfer film 14, a platen roller 18, a driving roller 15, an neutralization apparatus 1, etc. In FIG. 1, a portion which transfers a color image transferred to the intermediate transfer film 14 to a print medium is omitted.

The platen roller 18 is arranged so as to face the thermal head 16. The platen roller 18 moves between a position where the platen roller 18 presses the thermal head 16 and a position where the platen roller 18 separates from the thermal head 16.

One end of the ink ribbon 12 is wound around the supply axis 22, and the other end of the ink ribbon 12 is wound around the rolling up axis 24. A halfway part of the ink ribbon 12 prolonged between the supply axis 22 and the rolling up axis 24 is hung, turned and stretched by plural guide rollers, and passes between the thermal head 16 and the platen roller 18.

One end of the intermediate transfer film 14 is wound around the supply axis 26, and the other end of the intermediate transfer film 14 is wound around the rolling up axis 28. A halfway part of the intermediate transfer film 14 prolonged between the supply axis 26 and the rolling up axis 28 is hung, turned and stretched by plural guide rollers, and passes between the thermal head 16 and the platen roller 18. The ink ribbon 12 is arranged in the thermal head 16 side, and the intermediate transfer film 14 is arranged in the platen roller 18 side.

One guide roller 13 of the guide rollers which hang the intermediate transfer film 14 functions as a tension roller, and gives tension to the intermediate transfer film 14. The driving roller 15 for giving carrying force to the intermediate transfer film 14 is arranged between the tension roller 13 and the platen roller 18.

Hardness of the driving roller 15 is 30 to 60 degrees, and the intermediate transfer film 14 is rolled to the driving roller 15 so that a contact angle may become large as much as possible. In the embodiment, the intermediate transfer film 14 is wound around the driving roller 15 by the contact angle of 90 to 130 degrees. In order to control correctly the amount of conveyance of the intermediate transfer film 14, the driving roller 15 is combined with a deceleration mechanism which includes a 5-phase stepping motor which is not illustrated, a timing belt and a pulley.

The ink ribbon 12 has an ribbon-like resin film and an ink layer held on the surface of the resin film. The ink layer contains a fusion ink of five colors, such as yellow (Y), magenta (M), cyan (C), black (K), and transparence (T), for example. The ink of each color is arranged in a stripe shape in a direction perpendicular to a longitudinal direction of the resin film. A thickness of the resin film and a thickness of the ink layer are very important parameters in respect of the reproducibility of printing dots. A total thickness of the ink ribbon 12 is 3 to 25 micrometers preferably, and is about 4 to 10 micrometers more preferably. The ink ribbon 12 corresponds to a ribbon-like substance which generates static electrical charge by stripping.

The intermediate transfer film 14 includes a ribbon-like resin film and a transfer layer which is adhered to the surface of the resin film. The transfer layer functions as an adhesive layer while functioning as an image receiving layer. A thickness of the resin film and a thickness of a transfer layer are parameters which affect adhesiveness and a film cutting characteristic. A total thickness of the intermediate transfer film 14 is 10 to 100 micrometers preferably, and is about 25 to 50 micrometers more preferably. The ink ribbon 12 and the intermediate transfer film 14 are arranged so that the ink layer of the ink ribbon 12 and the transfer layer of the intermediate transfer film 14 may face each other between the thermal head 16 and the platen roller 18.

The thermal head 16 is a near edge type thermal head or a corner edge type thermal head. The thermal head 16 performs printing by the peeling-off during hot state which peels the ink from the resin film before the temperature of the ink falls. The thermal head 16 is installed so as to incline against a running surface of the ink ribbon 12 as shown in FIG. 1. Thereby, an environment which electric discharge based on Paschen's law tends to occur is formed between the thermal head 16 and the ink ribbon 12.

The ink ribbon 12 is sent out from the supply axis 22 and is wound around the rolling up axis 24. The ink ribbon 12 is conveyed between the thermal head 16 and the platen roller 18 in a state where the ink ribbon 12 is stretched by the guide rollers. On the other hand, the intermediate transfer film 14 is sent out from the supply axis 26 and is wound around the rolling up axis 28, or is sent out from rolling up axis 28 and is wound around the supply axis 26. The intermediate transfer film 14 is conveyed in both a forward direction and a reverse direction between the thermal head 16 and the platen roller 18 in a state where the intermediate transfer film 14 is stretched by the guide rollers.

The ink ribbon 12 and the intermediate transfer film 14 pass the thermal head 16, and the ink of the ink ribbon 12 is transferred to the intermediate transfer film 14. At this time, the platen roller 18 contacts the thermal head 16 via the ink ribbon 12 and the intermediate transfer film 14. Thereby, the ink layer of the ink ribbon 12 and the transfer layer of the intermediate transfer film 14 are in contact mutually with each other between the thermal head 16 and the platen roller 18. Each transcriptional region of the ink ribbon 12 and the intermediate transfer film 14 synchronizes and is conveyed at the same speed in a forward direction. When the intermediate transfer film 14 is conveyed to an opposite direction of the conveyance direction of the ink ribbon 12, the platen roller 18 separates from the thermal head 16, and the contact with the intermediate transfer film 14 and the ink ribbon 12 is released.

That is, when each of the color inks is transferred, the ink layer and the transfer layer contact each other, and the ink ribbon 12 and the intermediate transfer film 14 are conveyed between the thermal head 16 and the platen roller 18. At this time, the ink of each color of the ink ribbon 12 is heated and fused by the thermal head 16, and the ink dot according to a printing signal is transferred to the transfer layer of the intermediate transfer film 14. The ink ribbon 12 of which the ink was transferred to the intermediate transfer film 14 is wound around the rolling up axis 24.

In order to transfer the color image, the ink of other color is further transferred to the intermediate transfer film 14. After the intermediate transfer film 14 on which the ink dot was transferred is conveyed to the reverse direction, the ink of other color is further transferred on the transfer layer of the intermediate transfer film 14. Only the number of the color ink to print, the transfer of the ink is repeated. At this time, the platen roller 18 also separates from the thermal head 16 and contacts the thermal head 16 only the number of times corresponding to the number of the color ink to print.

The intermediate transfer film 14 on which the color image was thus transferred is conveyed by the driving roller 15. Then, the intermediate transfer film 14 passes a heating roller which is not illustrated. The heating roller is arranged in a lower stream side than the driving roller 15, and is arranged in the resin film side of the intermediate transfer film 14. A conveyance mechanism which is not illustrated conveys the print medium, such as an ID card or a bank passbook which is not illustrate along the surface of the intermediate transfer film 14. When the intermediate transfer film 14 passes the heating roller, the transfer layer holding the ink of the transferred color image is transferred to the print medium. Thereby, the color image is formed on the surface of the print medium. The intermediate transfer film 14 of which the transfer layer was transferred to the print medium is wound by the rolling up axis 28.

A printing method by the printer 10 above-mentioned is a hot melt transfer method. The hot melt transfer method has following features. 1) Durability of an image is high. 2) It is comparatively easy to apply functional materials, such as a fluorescent pigment and an aluminum vapor deposition thin film, for example, to the ink material. Therefore the hot melt transfer method is suitable for a printed matter aiming at forgery prevention. In addition, ink ribbon having only monochrome ink may be used as the ink ribbon 12. The ink ribbon 12 may have a ribbon material which has functions, such as a fluorescent pigment ink which emits light by ultraviolet rays, a metallic thin film layer for printing which has a glossy surface, for example, an aluminum vapor deposition layer, or a hologram layer for printing.

The printer 10 has the neutralization apparatus 1 arranged between the supply axis 22 of the ink ribbon 12 and the thermal head 16. As shown in FIG. 2, the neutralization apparatus 1 has a neutralization unit 33 grounded and a neutralization brush 32 grounded. The neutralization unit 33 is located in the surface side, i.e., a ink layer side 12*a*, of the ink ribbon 12, and the neutralization unit 33 is arranged so as to contact the surface of the ink ribbon 12. The neutralization brush 32 is located in the back side, i.e., the resin film side 12*b*, of the ink ribbon 12, and the neutralization brush 32 is arranged so as to separate from and not to contact with the ink ribbon 12.

The neutralization unit 33 grounded generates the electrical discharge based on Paschen's law with the surface of the ink ribbon 12. In the embodiment, a conductive roller 34 was used as the neutralization unit 33. The conductive roller 34 is attached to an arm, which is not illustrated, via a conductive grease bearing, and is grounded by grounding the arm. The conductive roller 34 is arranged so that a peripheral surface may contact the surface of the ink ribbon 12. The conductive roller 34 is a metallic roller, a conductive rubber roller, or a conductive sponge roller, for example. In the embodiment, the metallic roller 34 is used as the conductive roller 34. The neutralization brush 32 grounded is a self-discharge type neutralization brush of which a brush section 31 is formed by conductive fibers grounded. The neutralization brush 32 is arranged in a lower stream side of the ink ribbon 12 than the conductive roller 34, and separates from the conductive roller 34 8 cm, for example.

Before explaining the neutralization operation of the neutralization apparatus 1 of the present invention, electrification and neutralization of the ink ribbon 12 will be explained. First, the electrification of the ink ribbon 12 will be explained.

Since the ink ribbon 12 has the resin film as a substrate, the ink ribbon 12 produces static electrical charge by stripping when the ink ribbon 12 is sent out from the supply axis 22. Facing surfaces of the ink ribbon 12 which is exfoliated and the ink ribbon 12 which remains are charged to mutually different polarity, and those potentials are almost the same. For this reason, both surfaces of the ink ribbon 12 sent out from the supply axis 22 are charged to different polarity with different timing by one round.

The ink ribbon 12 of this example holds the ink of five colors of the stripe shape arranged one by one along with the longitudinal direction of the ink ribbon 12. The electrification of the ink ribbon 12 produced by stripping is changed according to the overlap condition of the ink held at the part with which the ink ribbons overlap. For this reason, the electrification of the ink ribbon 12 changes with the part of the ink ribbon 12. Even if the ink ribbon is considered simply, a difference is produced in the electrification characteristic by the difference in the color (kind) of the ink. That is, when the electrification by stripping is produced, differences are produced in charged polarity and the quantity of electrification. Further, since a diameter of the rolled form ink ribbon 12 currently wound around the supply axis 22 becomes small gradually by sending out the ink ribbon 12, the combination of the colors of the ink ribbon 12 overlapping also changes. For these reasons, the electrification characteristic changes variously with time.

Figure 3:
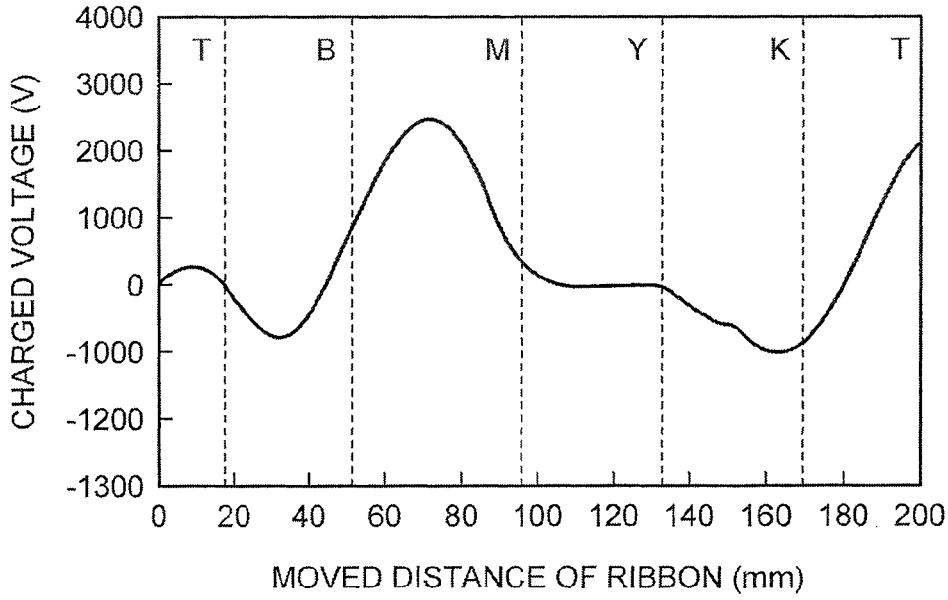
FIG. 3 is a graph showing an example of a measurement result of a charged voltage of an ink ribbon was measured.
Figure 4:
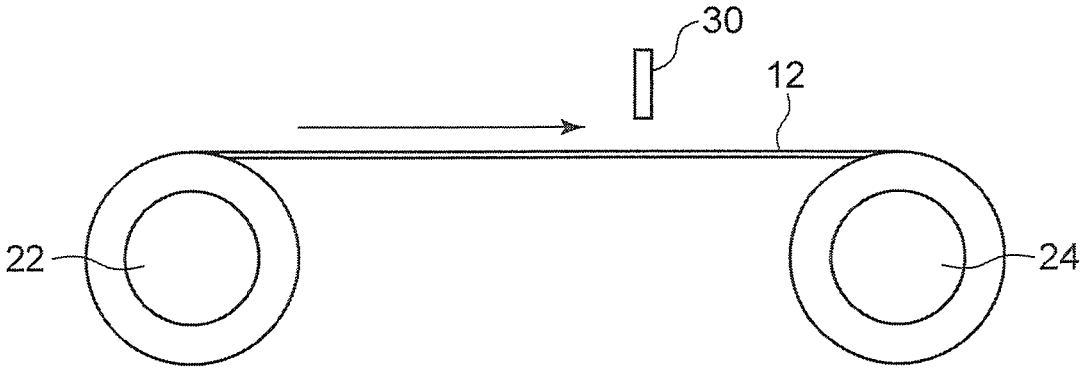
FIG. 4 is a schematic diagram explaining a static electricity sensor for measuring the electrification state of the ink ribbon.

FIG. 3 is a graph showing an example of the electrification characteristic when the ink ribbon 12 of the embodiment is exfoliated and is sent out. The electrification state of the ink ribbon 12 sent out from the supply axis 22 side was measured by a static electricity sensor 30 arranged to separate from the surface of the ink ribbon 12, as shown in FIG. 4. According to FIG. 3, it is understood that the charged voltage of the ink ribbon 12 measured by the static electricity sensor 30 changes with measured regions of the ink ribbon 12, and there is no regularity in the polarity of the electrification.

The static electricity sensor 30 used here is a surface potential meter of a noncontact type. When a charged voltage of a thin resin film like the ink ribbon 12 is measured, the charged voltage of the resin film is measured as total of an electrical charge in the surface and an electrical charge in the back. As mentioned above in many cases, the electrification charge of the surface of the ink ribbon 12 and the electrification charge of the back of the ink ribbon 12 become opposite polarity each other, so that a measured value which the static electricity sensor 30 shows becomes a charged voltage of electrical charge obtained by offsetting the electrical charge of the surface and the electrical charge of the back of the resin film. The measured value which has a peak in plus side or minus side in the graph of FIG. 3 shows a part of which the electrical charge of the ink ribbon 12 inclined toward either the surface or the back.

The graph of FIG. 3 shows that a part of the ink ribbon 12 having the red ink tends to show the charged voltage of plus, for example. However, in a part of the red ink which appears in next, a waveform of the graph showing the electrification characteristic does not necessarily become the same waveform as FIG. 3. That is, although a tendency of the electrified polarity is decided in general by color of the ink, the charged voltage does not necessarily become the same. Thus, since there is no regularity in the electrification of the ink ribbon 12 produced by stripping, it is impossible to quantify the change of the charged voltage.

However, as apparent from the graph of FIG. 3, the ink ribbon 12 which produced the electrification by stripping has a part of which the charged voltage is remarkably large. When the part with large charged voltage passes the thermal head 16, a possibility that the electrical discharge based on Paschen's law will occur between the ink ribbon 12 and the thermal head 16 is high. If the electrical discharge is produced between the ink ribbon 12 and the thermal head 16, a drive circuit for a heater element of the thermal head 16 will be destroyed at worst.

In order to prevent destruction of the thermal head 16 by the electrical discharge mentioned above, it is desirable to fully remove or eliminate the electrical charge charged to the ink ribbon 12 by neutralization before the ink ribbon 12 is sent to the thermal head 16. It is practically impossible to adopt a large-scale device using a high voltage power supply like a prior art as a neutralization apparatus of this kind of the printer 10. The inventors studied a possibility of the neutralization method which uses a neutralization brush which is compact, is easy to obtain, and is small in initial cost and running cost.

Next, the neutralization brush grounded and its effective result will be explained. The neutralization brush grounded here is a self-discharge type brush formed by the grounded conductive fiber.

When neutralizing static electrical charge of the ribbon-like substance produced by stripping using such neutralization brush, the neutralization brush is usually arranged to separate from the surface of the ribbon-like substance, and ion is generated by producing the electrical discharge between the neutralization brush and the ribbon-like substance. A ribbon-like substance is a resin film, for example. That is, the electrical charge of an opposite polarity is induced to the neutralization brush by the electrostatic induction from the charged resin film, and a corona discharge is produced by the potential difference between the neutralization brush and the resin film. And then, the static electrical charge of the resin film is removed by the ion generated by this corona discharge. At this time, in order to remove the static electrical, charge of the resin film effectively, it is necessary to generate a lot of ion. To generate a lot of ion, it is necessary to make comparatively large potential difference between the neutralization brush and the resin film which is an object of which the static electrical charge is removed, and to produce the corona discharge.

Even if the potential difference between the charged resin film and the neutralization brush is small, the electrical discharge will be produced by narrowing the distance between the charged resin film and the neutralization brush. However, since electrical discharge energy is small, a quantity of the ion generated is small and the effective result of removing the static electrical charge is not enough.

Figure 5:
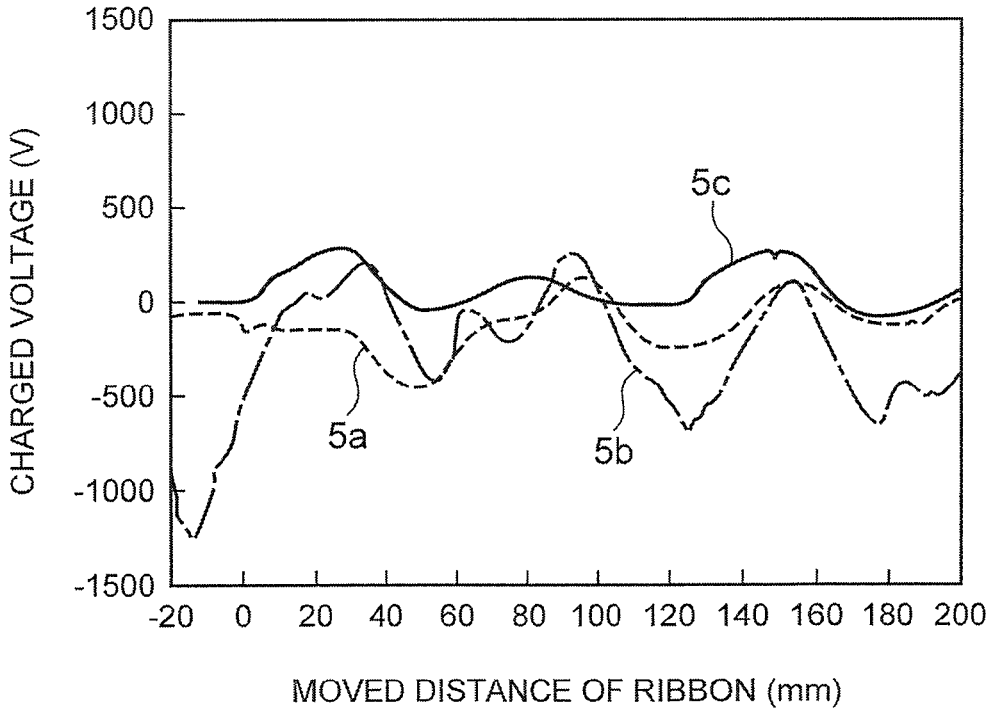
FIG. 5 is a graph showing the charged voltages in case a neutralization brush counters the ink ribbon.

In order to investigate the effective result of removing the static electrical charge of the ribbon-like substance in the case of using only the neutralization brush, the charged voltage of the ink ribbon was measured after the self-discharge type neutralization brush countering the ink ribbon had removed the electrification of the ink ribbon. The charged voltage was measured by the static electricity sensor 30 mentioned above which countered the surface, i.e., the ink layer of the ink ribbon 12. FIG. 5 shows the result.

Figure 6:
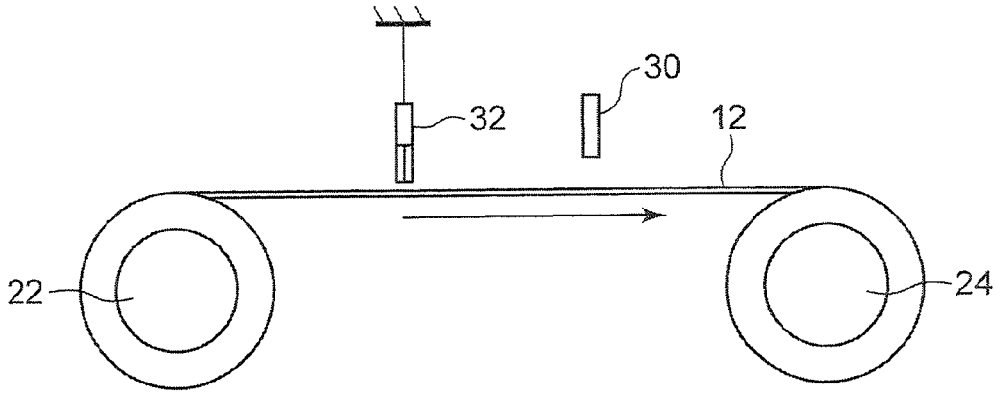
FIG. 6 is a schematic diagram showing a state where the neutralization brush counters the surface of the ink ribbon.
Figure 7:
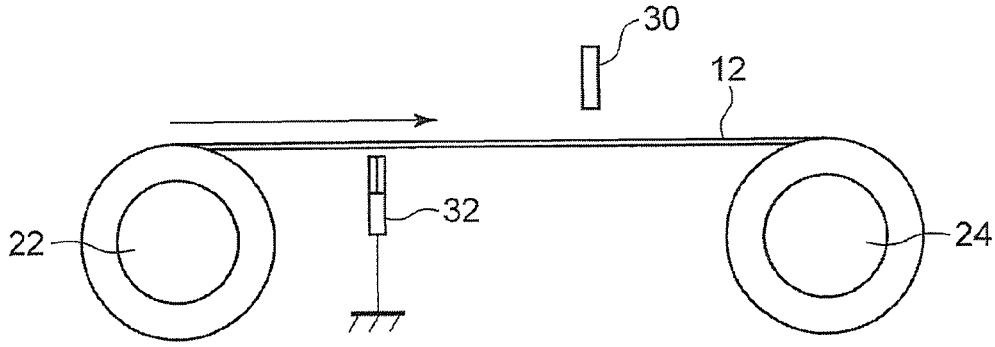
FIG. 7 is a schematic diagram showing a state where the neutralization brush counters the back of the ink ribbon.

In FIG. 5, a curve 5*a* shows a measurement result of a charged voltage measured when the neutralization brush 32 countered the surface of the ink ribbon 12, as shown in FIG. 6. A curve 5*b* shows a measurement result of a charged voltage measured when the neutralization brush 32 countered the back, i.e., the resin film of the ink ribbon 12, as shown in FIG. 7. And a curve 5*c* shows a measurement result of a charged voltage of the ink ribbon 12 measured when the neutralization brush 32 was not arranged, for comparison.

According to FIG. 5, it seems that the curves 5*a* and 5*b* shift to the minus side slightly as compared with the curve 5*c*. It is considered that such change of the charged voltage is caused by removing the static electrical charge slightly only from one surface of the ink ribbon 12. That is, the change of charged voltage is considered to be caused by what a balance of the electrical charge charged to the surface and the electrical charge charged to the back of the ink ribbon 12 is broken.

That is, the electrical charge electrostatically induced to the neutralization brush 32 depends on the charged voltage of the ink ribbon 12. When the neutralization brush 32 removes the electrical charge of the ink ribbon 12 in the state where the balance of the electrical charge of the surface and the electrical charge of the back is kept, a quantity of the electrical charge generated in the neutralization brush 32 by electrostatic induction is small. For this reason, in removing the electrical charge only using the neutralization brush 32, a large potential difference cannot be formed between the neutralization brush 32 and the ink ribbon 12, and a sufficiently large corona discharge cannot be generated. Accordingly, the electrical charge of the ink ribbon 12 is not sufficiently removed. In addition, the same thing as what can be said when the neutralization brush 32 counters the surface of the ink ribbon 12, can be said when the neutralization brush 32 counters the back of the ink ribbon 12.

The ion generated by the electrical discharge by the neutralization brush 32 does not penetrate the ink ribbon 12, so that there is no removal operation of the electrical charge in the opposite side which the neutralization brush 32 dose not counter. Therefore, even if only the neutralization brush acts on the ink ribbon 12, the electrical charge cannot be removed efficiently because the potential difference is small and the ion does not penetrate the ink ribbon 12.

In case of the electrification produced by stripping to the ribbon-like substance mentioned above, for example, the ink ribbon 12, the charged voltage of the ink ribbon becomes a charged voltage of electrical charge obtained by offsetting the electrical charge of the surface of the ink ribbon 12 and the electrical charge of the back of the ink ribbon 12. For this reason, it is difficult to make a large potential difference between the ink ribbon 12 and the neutralization brush 32. Even if each surface of the ink ribbon 12 has much electrical charge, only a little electrical charge will be induced to the neutralization brush 32. That is, since it is difficult to generate a sufficiently large corona discharge between the neutralization brush 32 and the ink ribbon 12, the electrical charge of the ink ribbon 12 cannot be removed effectively by the neutralization method only using the neutralization brush 32.

Next, the neutralization roller grounded and its effective result will be explained.

Figure 8:
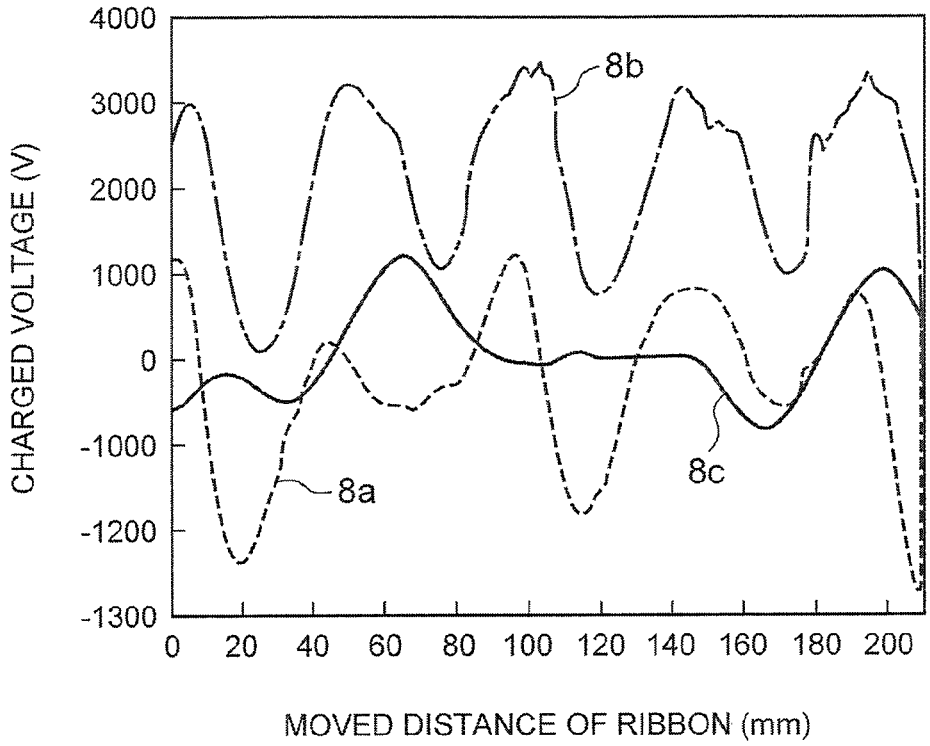
FIG. 8 is a graph showing the charged voltages in case a conductive roller contacts the ink ribbon.

In order to investigate the neutralization effective result of the charged ribbon-like substance by the conductive roller 34, the charged voltage of the ink ribbon 12 was measured after removing the electrical charge of the ink ribbon 12 by the metallic roller 34 grounded. Measurement of the charged voltage uses the static electricity sensor 30 mentioned above which counters the surface of the ink ribbon 12. FIG. 8 shows the result.

Figure 9:
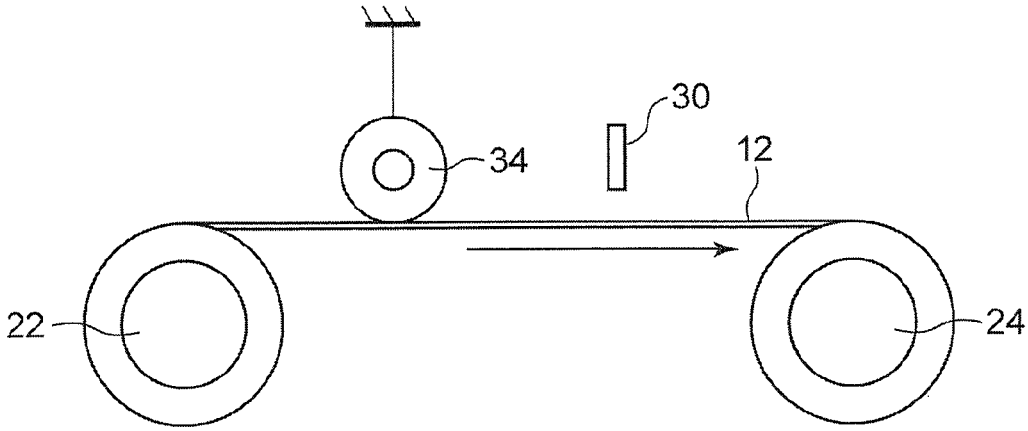
FIG. 9 is a schematic diagram showing a state where the conductive roller contacts the surface of the ink ribbon.
Figure 10:
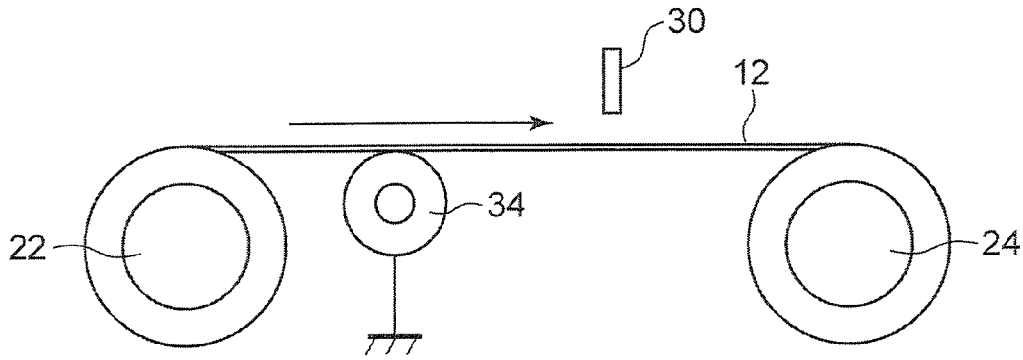
FIG. 10 is a schematic diagram showing a state where the conductive roller contacts the back of the ink ribbon.

In FIG. 8, a curve 8*a* shows a measurement result of a charged voltage measured when a peripheral surface of the metallic roller 34 contacts the surface of the ink ribbon 12, i.e., the ink layer as shown in FIG. 9. A curve 8*b* shows a measurement result of a charged voltage measured when the peripheral surface of the metallic roller 34 contacts the back of the ink ribbon 12, i.e., the resin film, as shown in FIG. 10. A curve 8*c* shows a measurement result of a charged voltage of the ink ribbon 12 measured when the electrical charge was not removed, for comparison.

According to FIG. 8, followings are understood. 1) The curves 8*a* and 8*b* are changed more sharply than the curve 8*c*. That is, the charged voltage of the ink ribbon 12 is changed sharply when the metallic roller 34 contacting the surface or the back of the ink ribbon 12 removes the electric charge of the ink ribbon 12. 2) The curve 8*a* measured when the metallic roller 34 contacts the surface of ink ribbon 12 and the curve 8*b* measured when the metallic roller 34 contacts the back of ink ribbon 12 are separated greatly.

Also from FIG. 8, it is thought that the balance of the electrical charge of the surface of the ink ribbon 12 and the electrical charge of the back of the ink ribbon 12 is broken greatly when the electrical charge of only one side of the ink ribbon 12 is removed with the metallic roller 34. It is also thought that the charged voltage of the ink ribbon 12 measured with the static electricity sensor 30 was changed sharply as a result. When the curves 8*a* and 8*b* are especially compared with the curves 5*a* and 5*b* in FIG. 5 showing the case where only the neutralization brush 32 is used, the curves 8*a* and 8*b* largely changes in the charged voltage. From these things, it is understood that the metallic roller 34 in contact with the ink ribbon 12 can remove more electrical charge than the neutralization brush which is separated from and counters the ink ribbon 12.

Figure 11:
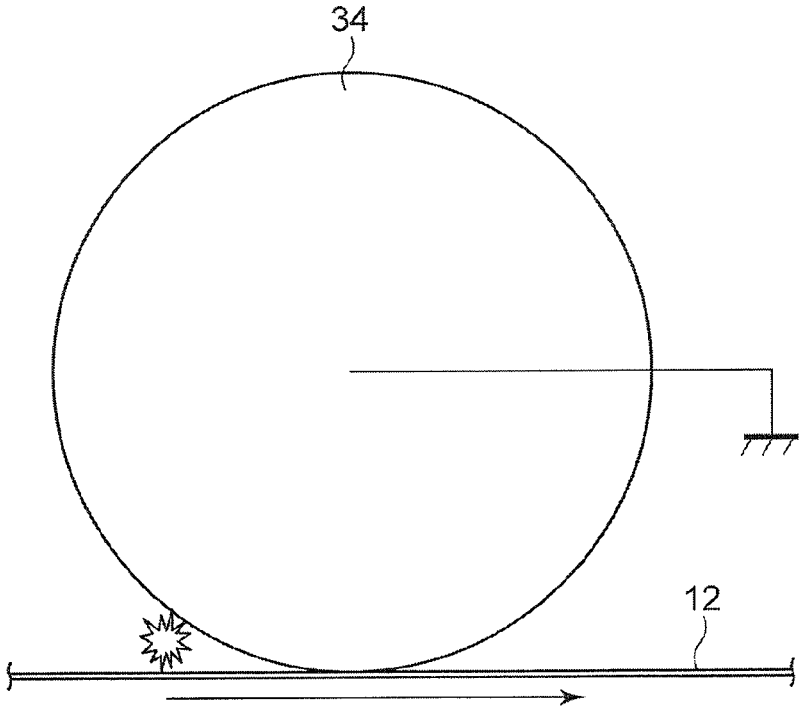
FIG. 11 is a enlarged drawing of a part where the conductive roller of FIG. 9 which contacts the ink ribbon.

FIG. 11 is an enlarged drawing of a part of the metallic roller 34 grounded which is in contact with the surface of the ink ribbon 12. When the metallic roller 34 grounded contacts the surface of the ink ribbon 12 which is conveyed in a direction of an arrow, the distance between the metallic roller 34 and the ink ribbon 12 lessens gradually towards a contact point based on a shape of a curved peripheral surface of the metallic roller 34. If the distance between the peripheral surface of the metallic roller 34 and the surface of the ink ribbon 12 approaches to a certain distance decided considering the charged voltage of the ink ribbon 12 and an atmospheric pressure as parameter, corona discharge based on Paschen's law will occur between the peripheral surface of the metallic roller 34 and the surface of the ink ribbon 12. The neutralization by the metallic roller 34 is performed by the corona discharge based on Paschen's law.

Figure 12:
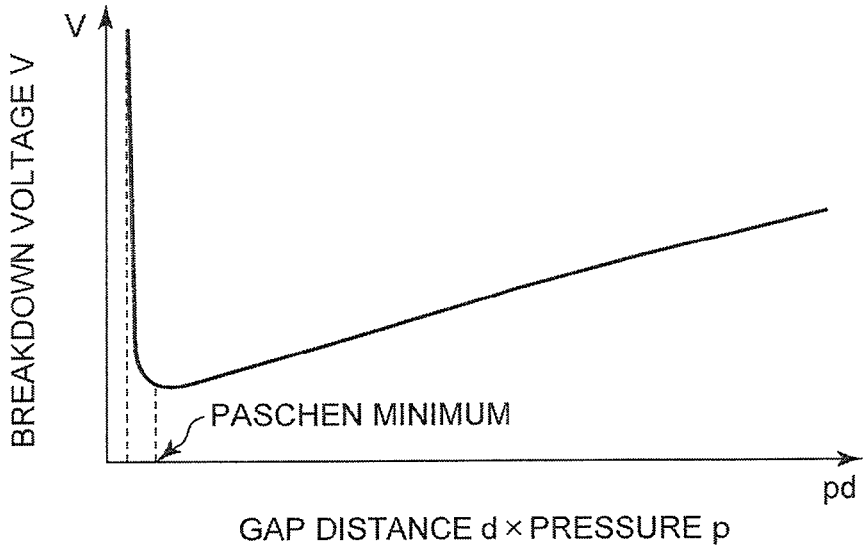
FIG. 12 shows a graph showing Paschen's curve.

FIG. 12 shows Paschen curve. The corona discharge based on Paschen's law occurs when a distance between electrodes having a certain fixed potential difference approaches to a certain fixed distance. In this case, the electrodes having the fixed potential difference correspond to the metallic roller 34 and the ink ribbon 12. The potential difference between the electrodes at this time is the minimum voltage of the electrical discharge, however, the electrical discharge does not occur when the distance between the electrodes becomes smaller than this. This distance is called Paschen minimum. On the contrary, if the distance between electrodes becomes large exceeding the Paschen minimum, the voltage to generate the electrical discharge will become large gradually. The Paschen minimum is about 7.5 micrometers when the potential difference of 330V is given to the electrodes in the 1-atmosphere air, for example.

The charged voltage of the ink ribbon 12 becomes a charged voltage of electrical charge obtained by offsetting the electrical charge of the surface and the electrical charge of the back, as mentioned above. Thus, the potential difference between the peripheral surface of the metallic roller 34 grounded and the ink ribbon 12 does not become so large. However, the corona discharge produces when the distance between both approaches to the Paschen minimum mentioned above. Thereby, the ion can be generated in the surface side of the ink ribbon 12 and the electrical charge of the surface can be removed. Therefore, the metallic roller 34 in contact with the ink ribbon 12 is considered to have higher neutralization effect than the discharge brush 32 shown in FIG. 6 and FIG. 7. Since the generated ion does not influence the back side of the ink ribbon 12, only the surface side of the ink ribbon 12 which the metallic roller 34 contacts can be neutralized.

As mentioned above, when the neutralization is performed by the electrical discharge based on Paschen's law using the metallic roller 34, the electrical charge of the one surface of the ink ribbon 12 can be removed effectively. As a result, the balance of the electrification of the surface and the back of the ink ribbon 12 can be broken largely, and the charged voltage of the other surface of the ink ribbon 12 can be enlarged.

Next, an operation of the present invention will be explained. As mentioned above, the corona discharge based on Paschen's law is generated between the surface of the ink ribbon 12 and the metallic roller 34 by using the metallic roller 34 grounded. That is, the corona discharge based on Paschen's law is generated between the ink layer and the neutralization apparatus using the grounded neutralization apparatus. Thereby, the electrical charge of the surface of the ink ribbon 12 is removed, and the balance of the quantity of electrification of the surface and the quantity of electrification of the back of ink ribbon 12 is broken. Accordingly, as shown in FIG. 8, the charged voltage of the ink ribbon 12 can be enlarged in lower stream of the conveyance direction of the ink ribbon 12. And by using the neutralization brush 32 grounded, the corona discharge is produced between the neutralization brush 32 and the back of the ink ribbon 12 where the large charged voltage appears. That is, the corona discharge is produced between the resin film of the ink ribbon 12 and the neutralization brush 32. By generating a lot of ion in the back side of the ink ribbon 12, the electrical charge of the back side of the ink ribbon 12 can be removed effectively.

Figure 13:
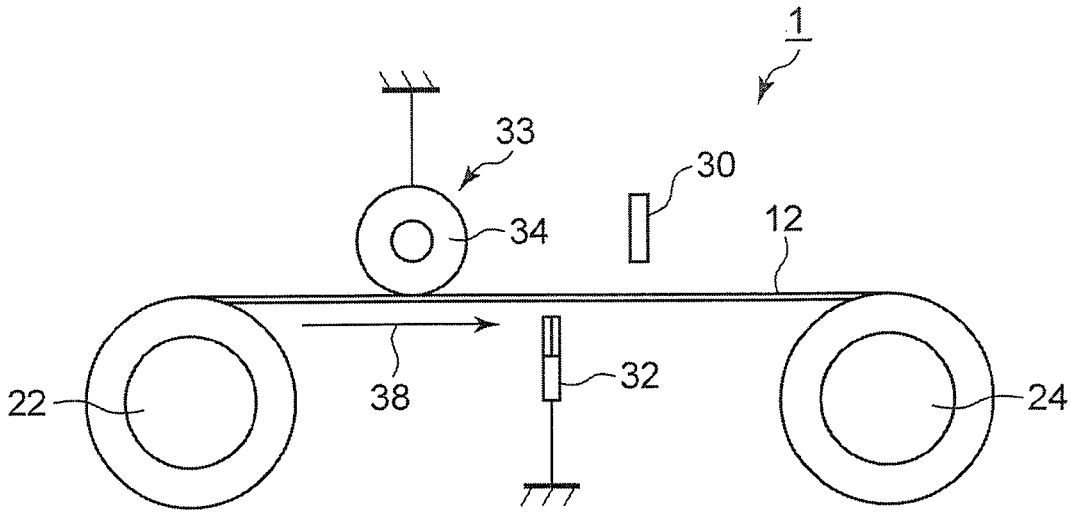
FIG. 13 is a schematic diagram showing a state where the static electricity sensor is added to the neutralization apparatus concerning the embodiment.

The invention was made based on the above-mentioned knowledge. Hereafter, the neutralization apparatus of the invention will be explained in detail including its mechanism. FIG. 13 shows a schematic diagram in the state where the neutralization apparatus 1 of the embodiment is attached to the ink ribbon 12. In order to confirm the neutralization effect by the neutralization apparatus 1, the static electricity sensor 30 is arranged in a lower stream side than the neutralization apparatus 1.

The neutralization apparatus 1 has the metallic roller 34 grounded and the self-discharge type neutralization brush 32 grounded. The metallic roller 34 grounded is arranged so that a peripheral surface of the metallic roller 34 contacts the surface of ink ribbon 12, i.e., the ink layer. The self-discharge type neutralization brush 32 grounded is arranged so as to counter the back of the ink ribbon 12, i.e., the resin film. The metallic roller 34 grounded is arranged in an upper stream side along the conveyance direction of the ink ribbon 12, that is, a direction of an arrow 38. And the self-discharge type discharge brush 32 grounded is arranged so as to separate from the ink ribbon 12 in the lower stream side than the metallic roller 34 along the conveyance direction of the ink ribbon 12. The metallic roller 34 grounded functions as the neutralization unit 33.

It is required that the electrical field by the neutralization unit 33 does not affect the neutralization function of the neutralization brush 32. Therefore, the metallic roller 34 and the neutralization brush 32 are mutually separated a predetermined distance at least along the conveyance direction of the ink ribbon 12. That is, the distance from a position where the metallic roller 34 contacts the surface of the ink ribbon 12 to a position where the neutralization brush 32 counters the back of the ink ribbon 12 is larger than the distance which the electrical field by the metallic roller 34 does not affect the neutralization function of the neutralization brush 32 at least along the conveyance direction of the ink ribbon 12. In particular, a minimum distance Dmin with which the potential affected by influence becomes less than 100 volts is expressed by following formula when the charged voltage of the ink ribbon 12 is E volts.

$$Dmin=7\times10^{-4}\times E[m]$$

For this reason, the position where the metallic roller 34 contacts the surface of the ink ribbon 12 is desirably 70 mm and more away from the position where the neutralization brush 32 counters the back of the ink ribbon 12.

When neutralizing the ink ribbon 12 using this neutralization apparatus 1, the metallic roller 34 arranged in the upper stream side of the conveyance direction of the ink ribbon 12 removes the electrical charge of the surface of the ink ribbon 12 by the electrical discharge based on Paschen's law first. Thereby, the balance of the quantity of electrification of the surface of the ink ribbon 12 and the quantity of electrification of the back of the ink ribbon 12 is broken, and the charged voltage of the ink ribbon 12 becomes large. And then, the neutralization brush 32 arranged in the lower stream side removes the electrical charge of the back of the ink ribbon 12. At this time, since the potential difference between the ink ribbon 12 and the neutralization brush 32 becomes comparatively large, the sufficiently large electrical discharge is produced even if the neutralization brush 32 separates from the back of the ink ribbon 12. Accordingly, the electrical discharge generates a lot of ion and removes the electrification of the back of the ink ribbon 12 effectively.

Figure 14:
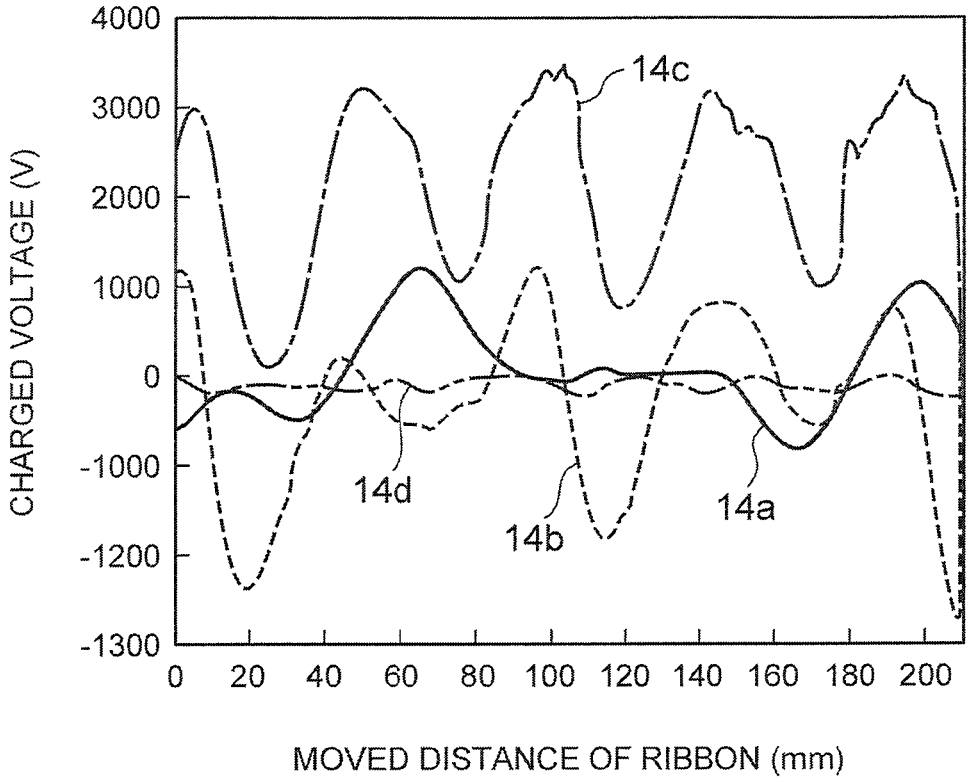
FIG. 14 shows a graph explaining effective result of neutralization using the neutralization apparatus shown in FIG. 13.

FIG. 14 shows a graph for verifying the effective result of the embodiment. A curve 14*a* shows a charged voltage in case the ink ribbon 12 is not neutralized at all. A curve 14*b* shows a charged voltage in case the metallic roller 34 contacts the surface of the ink ribbon 12. A curve 14*c* shows a charged voltage in case the metallic roller 34 contacts the back of the ink ribbon 12. A curve 14*d* shows a charged voltage in case the metallic roller 34 contacts the surface of the ink ribbon 12 and the neutralization brush 32 counters the back of the ink ribbon 12 in the lower stream side. The charged voltage was measured with the static electricity sensor 30 mentioned above.

According to FIG. 14, the curves 14*d* approaches zero most. That is, when the electrical charge of the ink ribbon 12 is removed by the neutralization apparatus 1 according to this embodiment, the charged voltage of the ink ribbon 12 approaches zero most. Since the charged voltage measured with the static electricity sensor 30 is measured as a charged voltage of electrical charge which is obtained by offsetting the electrical charge of the surface of ink ribbon 12 and the electrical charge of the back of the back of the ink ribbon 12, it cannot necessarily be said that the neutralization was performed effectively even if the measured value is zero. However, when the explanation of the operation of the neutralization mentioned above is taken into consideration, it is clear that the ink ribbon 12 was effectively neutralized by using the neutralization apparatus 1 of the embodiment.

In FIG. 13, the metallic roller 34 in the upper stream side contacts the surface of the ink ribbon 12, and the neutralization brush 32 in the lower stream side counters the back of the ink ribbon 12. On contrary to this, when the metallic roller 34 arranged in the upper stream side contacts the back of the ink ribbon 12 and the neutralization brush 32 arranged in the lower stream side counters the surface of the ink ribbon 12, the same effective result as the example shown in FIG. 13 is obtained.

In the embodiment, as a previous process for carrying out the neutralization by the neutralization brush 32 effectively, the neutralization by the electrical discharge based on Paschen's law using the metallic roller 34 was applied to one surface of the ink ribbon 12. Therefore, the potential difference between the neutralization brush 32 and other surface of the ink ribbon 12 can be enlarged. As a result, the neutralization brush 32 can be arranged so as to separate from the ink ribbon 12, a lot of ion caused by the corona discharge can be generated, and the electric charge of the ink ribbon 12 can be removed certainly and effectively. In addition, experiments show that a suitable distance (gap) between the neutralization brush 32 and the ink ribbon 12 is 1 mm to 3 mm in the case of using the self-discharge type neutralization brush 32.

In order to prevent breakage of the thermal head 16 by the electrical discharge between the ink ribbon 12 and the thermal head 16 in the printer 10, it is necessary to remove the electrical charge of the back of the ink ribbon 12 which is in contact with the thermal head 16. That is, it is necessary to remove the electrical charge of the resin film of the ink ribbon 12. For this reason, in the printer, it is necessary to place the neutralization brush 32 in the back side, i.e., the resin film side, of the ink ribbon 12.

As mentioned above, the neutralization apparatus 1 of this embodiment can remove the electrical charge of the ink ribbon 12 certainly. Accordingly, the printer of this embodiment can prevent producing the electrical discharge between the ink ribbon 12 and the thermal head 16 when the ink ribbon 12 passes the thermal head 16, and the printer can prevent destruction of the thermal head 16 caused by the electrical discharge.

Therefore, the neutralization apparatus of the invention can neutralize the electrical charge of the ribbon-like substance produced by stripping certainly and effectively. Since the neutralization apparatus of the invention does not use a high voltage power supply unlike the conventional large-scale neutralization apparatus, the neutralization apparatus of the invention can simplify apparatus composition and can reduce apparatus cost. And the printer of the invention using the neutralization apparatus can prevent the destruction of the thermal head caused by the electrical discharge.

The embodiment mentioned above used the metallic roller 34 as the neutralization unit 33. However, the neutralization unit 33 may use other neutralization unit which can generate the corona discharge based on Paschen's law. Other neutralization units will be explained below.

Figure 15:
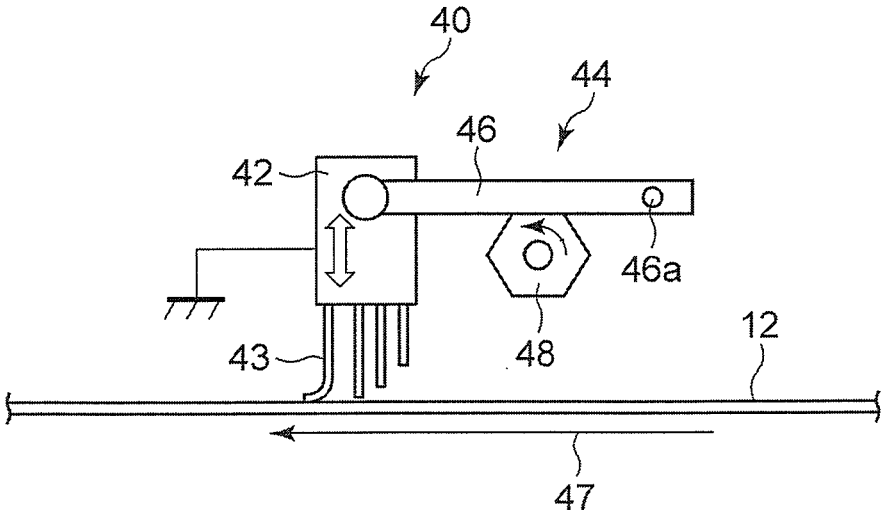
FIG. 15 is a schematic diagram showing a neutralization unit of another embodiment.

FIG. 15 shows a schematic diagram of a neutralization unit of another embodiment. The neutralization unit 40 uses a self-discharge type neutralization brush 42 grounded. When using this kind of neutralization brush, as mentioned above, it is generally desirable to enlarge the potential difference between the neutralization brush and a subject to be neutralized and to take a comparatively large distance between the neutralization brush and the subject to be neutralized. The neutralization unit of the invention is provided in order to break the balance of the electrical charge of the surface and the electrical charge of the back of the ink ribbon 12 in the state where the electrical charge of the surface and the electrical charge of the back are offset. Therefore, when the self-discharge type neutralization brush 42 grounded is used as the neutralization unit 40, the neutralization brush 42 must be arranged extremely close to the ink ribbon 12.

However, it is difficult to arrange the neutralization brush 42 close to the ink ribbon 12, and to manage the gap between both with high precision. It is nearly impossible to place and fix the neutralization brush 42 in a distance which serves as the Paschen minimum.

For this reason, the neutralization unit 40 of this embodiment uses the neutralization brush 42 which changed length of a brush part 43 gradually along the conveyance direction of the ink ribbon 12, i.e., a direction of an arrow 47. The neutralization brush 42 is arranged in a standing position as shown in FIG. 15, and the brush section 43 contacts the surface of the ink ribbon 12. A vibrating mechanism 44 vibrates the neutralization brush 42 in directions which the brush section 43 contacts the surface of the ink ribbon 12 and separates from the surface of the ink ribbon 12.

The vibrating mechanism 44 has an arm 46 which attaches the neutralization brush 42 at its tip, a cam 48 which acts on the arm 46, and a motor which rotates the cam 48 and which is not illustrated. When the motor rotates the cam 48, the cam 48 of a hexagon acts on the arm 46 and vibrates the arm 46. Vibration of the arm 46 vibrates the neutralization brush 42 in directions which the neutralization brush 42 separates from the ink ribbon 12 and the neutralization brush 42 contacts ink ribbon 12. When the neutralization brush 42 vibrates, the tip end of the brush section 43 of which the length was changed repeats contacting the surface of the ink ribbon 12 and separating from the surface of ink the ribbon 12. Some portions of the brush section 43 are always placed to the distance of the Paschen minimum against the ink ribbon 12.

Thus, high position accuracy of the neutralization brush 42 becomes unnecessary by changing the length of the brush section 43. Since the electrical discharge is always produced by some parts, the electrical charge of the surface of the ink ribbon 12 is removed effectively. Unlike the case where the neutralization brush is arranged so as to separate from the ink ribbon 12, the distance between the neutralization brush 42 and the surface of the ink ribbon 12 can be made small in this case. And since the electrical discharge based on Paschen's law is generated, the many electrical discharges can be generated with a low voltage difference. Thereby, sufficient quantity of the ion to break the balance of the electrical charge of the surface and the back of the ink ribbon can be generated.

It is not necessary to vibrate the neutralization brush 42 of the neutralization unit 40 explained in this embodiment. The effective result of the invention can be obtained by only changing the length of the brush. In this case, the vibrating mechanism 44 can be omitted and an apparatus composition can be simplified.

Figure 16:
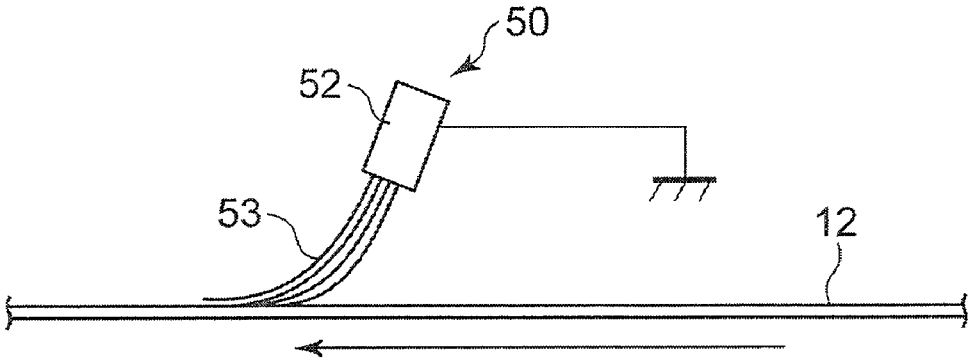
FIG. 16 is a schematic diagram showing a neutralization unit of still another embodiment.

FIG. 16 shows a schematic diagram of a neutralization unit of still another embodiment. The neutralization unit 50 is a self-discharge type neutralization brush 52 grounded which inclines so as to make an acute angle with the surface of the ink ribbon 12, and which contacts the surface of the ink ribbon 12. By forcing the brush section 53 of the neutralization brush 52 on the ink ribbon 12 with a posture shown in FIG. 16, the electrical discharge based on Paschen's law can be generated between the neutralization brush 52 and the ink ribbon 12.

Figure 17:
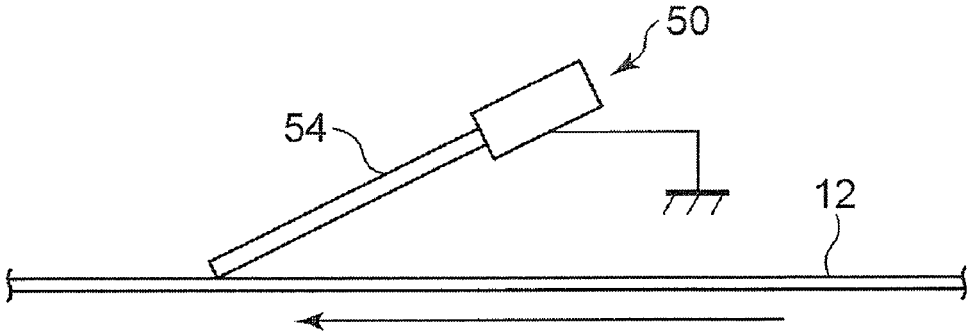
FIG. 17 is a schematic diagram showing a neutralization unit of further another embodiment.

In addition, as shown in FIG. 17, a metal plate 54 which inclines so as to make an acute angle with the surface of the ink ribbon 12, and which contacts the ink ribbon 12 can also be used as the neutralization unit 50. Also in this case, the electrical discharge based on Paschen's law can be generated, and the electrical charge of the surface of the ink ribbon 12 can be removed effectively.

Figure 18:
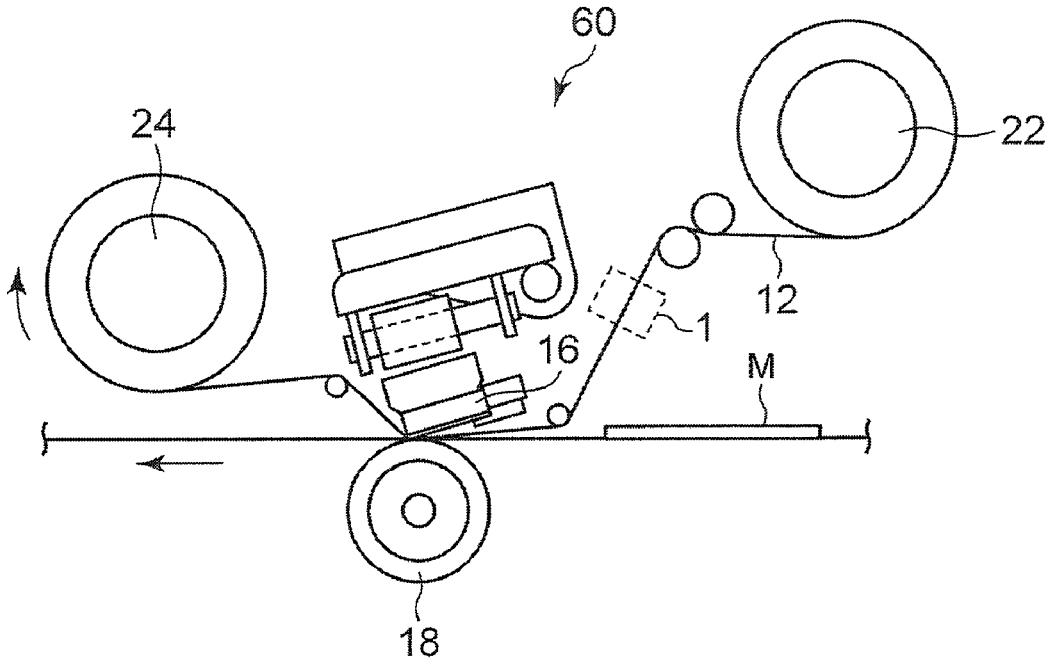
FIG. 18 is a schematic diagram showing a printer concerning another embodiment of the invention.

Further, the printer 10 of the embodiment mentioned above transfers the ink which the ink ribbon 12 holds to the intermediate transfer film 14, and further transfers the ink transferred on this intermediate transfer film 14 to the print medium together with the transfer layer. However, the invention is not restricted to this, but is applicable to the printer 60 shown in FIG. 18.

The printer 60 conveys a print medium M between the thermal head 16 and the platen roller 18, and transfers the ink of the ink ribbon 12 to the print medium M directly without using the intermediate transfer film 14. The neutralization apparatus 1 is attached to the ink ribbon 12 like the embodiment shown in FIG. 1. As the neutralization apparatus 1, the neutralization apparatus shown in FIG. 2 is used, for example. The printer 60 as well as the printer 10 of the embodiment mentioned above can prevent breakage of the thermal head by the electrical discharge.

In the embodiment mentioned above, the neutralization apparatus was applied to removal of the electrical charge of the ink ribbon 12 of the printer 10. However, the neutralization apparatus may be applied to removal of the electrical charge of the intermediate transfer film 14 of the printer if needed. Since the intermediate transfer film 14 uses as the substrate the resin film which is a substance to be electrically charged by stripping, the intermediate transfer film 14 is charged and has a problem that it adsorbs dust, for example. The neutralization apparatus of the invention is applicable to removal of the electrical charge of other ribbon-like substance which is electrically charged by stripping. As a ribbon-like substance to be charged by stripping, there are various materials, such as a laminate film, a plastic sheet, etc. for packing an article.

In addition, the invention is not limited to the above-mentioned embodiment as it is, and in a practical stage, a component can be changed without departing from the scope of the invention. Various inventions can be made with proper combination of a plurality of components currently indicated by the above-mentioned embodiment. For example, some components may be deleted from all the components shown in the embodiment. Furthermore, the component covering different embodiments may be combined suitably.

Other embodiments or modifications of the present invention will be apparent to those skilled in the art from consideration of the specification and practice of the invention disclosed herein. It is intended that the specification and example embodiments be considered as exemplary only, with a true scope and spirit of the invention being indicated by the following.

What is claimed is:

1. A neutralization apparatus, comprising:

a neutralization unit grounded which is in contact with one surface of a ribbon-like substance sent out from the ribbon-like substance wound around rolled form to generate static electrical charge by stripping, and the neutralization unit removes the static electrical charge charged to one surface of the ribbon-like substance by producing electrical discharge between the neutralization unit and the one surface of the ribbon-like substance; and a self-discharge type neutralization brush grounded which counters another surface of the ribbon-like substance and is separated from the ribbon-like substance in a lower stream side than the neutralization unit along a direction where the ribbon-like substance is sent out, and the self-discharge type neutralization brush removes the static electrical charge charged to the another surface of the ribbon-like substance.

2. The neutralization apparatus according to claim 1, wherein a distance from a position where the neutralization unit contacts the one surface of the ribbon-like substance to a position where the self-discharge type neutralization brush counters the another surface of the ribbon-like substance is larger than a distance which an electrical field formed by the neutralization unit does not affect to neutralization operation by the self-discharge type neutralization brush.

3. The neutralization apparatus according to claim 2, wherein a position where the neutralization unit contacts the one surface of the ribbon-like substance is 70 mm and more away from a position where the self-discharge type neutralization brush counters the another surface of the ribbon-like substance.

4. The neutralization apparatus according to claim 1, wherein the neutralization unit is a conductive roller and a peripheral surface of the conductive roller contacts the one surface of the ribbon-like substance.

5. The neutralization apparatus according to claim 4, wherein the conductive roller is any one selected from a metallic roller, a conductive rubber roller and a conductive sponge roller.

6. The neutralization apparatus according to claim 1, wherein the neutralization unit includes a second neutralization brush which has a brush material of which the length becomes long gradually along a direction where the ribbon-like substance is sent out, and the brush material contacts the one surface of the ribbon-like substance.

7. The neutralization apparatus according to claim 6, wherein the neutralization unit further includes a vibrating mechanism which vibrates the second neutralization brush in a direction which the second neutralization brush separates from the one surface of the ribbon-like substance and in a direction which the second neutralization brush contacts the one surface of the ribbon-like substance.

8. The neutralization apparatus according to claim 1, wherein the neutralization unit includes a second neutralization brush which has a brush material in contact with the one surface of the ribbon-like substance, and the brush material and the one surface of the ribbon-like substance makes an acute angle.

9. The neutralization apparatus according to claim 1, wherein the neutralization unit is a metal plate in contact with the one surface of the ribbon-like substance, and the metal plate and the one surface of the ribbon-like substance makes an acute angle.

10. The neutralization apparatus according to claim 1, wherein the ribbon-like substance is resin film.

11. The neutralization apparatus according to claim 1, wherein the ribbon-like substance is ink ribbon which has a resin film and an ink layer held on one surface of the resin film.

12. A printer, comprising:

a supply axis wound with an ink ribbon which has a ribbon-like resin film and an ink layer held on the ribbon-like resin film;

a rolling up axis configured to roll up the ink ribbon sent out from the supply axis;

a thermal head arranged in the resin film side of the ink ribbon which runs between the supply axis and the rolling up axis;

an neutralization unit grounded arranged so as to contact the resin film of the ink ribbon in an upper stream side than the thermal head along a direction where the ink ribbon is sent out from the supply axis, the neutralization unit being configured to remove electrical charge charged to the resin film by producing electrical discharge between the neutralization unit and the resin film; and a self-discharge type neutralization brush grounded arranged at a position in a lower stream side than the neutralization unit and in an upper stream side than the thermal head along a direction where the ink ribbon is sent out, and countering the ink layer of the ink ribbon.

13. The printer according to claim 12, wherein a distance from a position where the neutralization unit contacts the resin film to a position where the self-discharge type neutralization brush counters the ink layer is larger than a distance which electrical field formed by the neutralization unit does not affect to electrical discharge operation of the self-discharge type neutralization brush.

14. The neutralization apparatus according to claim 12, wherein a position where the neutralization unit contacts the resin film is 70 mm and more away from a position where the self-discharge type neutralization brush counters the ink layer.

15. The neutralization apparatus according to claim 12, wherein the neutralization unit is a conductive roller and a peripheral surface of the conductive roller contacts the resin film.

16. The printer according to claim 15, wherein the conductive roller is any one selected form a metallic roller, a conductive rubber roller and a conductive sponge roller.

17. The printer according to claim 12, wherein the neutralization unit includes a second neutralization brush which has a brush material of which length becomes long gradually along a direction where the ink ribbon is sent out, and wherein the brush material contacts the resin film.

18. The neutralization apparatus according to claim 17, wherein the neutralization unit further includes a vibrating mechanism which vibrates the second neutralization brush in a direction which the second neutralization brush separates from the resin film and in a direction which the second neutralization brush contacts the resin film.

19. The neutralization apparatus according to claim 12, wherein the neutralization unit is a second neutralization brush which has a brush material in contact with the resin film, and the brush material and the resin film make an acute angle.

20. The neutralization unit according to claim 12, wherein the neutralization unit is a metal plate in contact with the resin film and the metal plate and the resin film make an acute angle.

* * * * *